US008472660B2

(12) United States Patent
Wengreen

(10) Patent No.: US 8,472,660 B2
(45) Date of Patent: Jun. 25, 2013

(54) HEADPHONE ADAPTATION AND POSITIONING DEVICE WITH MEANS FOR HOLDING AN EARBUD STEM

(75) Inventor: Eric John Wengreen, Stanford, CA (US)

(73) Assignee: Innovelis, Inc., Issaquah, WA (US)

( * ) Notice: Subject to any disclaimer, the term of this patent is extended or adjusted under 35 U.S.C. 154(b) by 173 days.

(21) Appl. No.: 13/031,213

(22) Filed: Feb. 20, 2011

(65) Prior Publication Data

US 2011/0164778 A1 Jul. 7, 2011

Related U.S. Application Data

(63) Continuation of application No. 12/133,435, filed on Jun. 5, 2008.

(60) Provisional application No. 60/943,557, filed on Jun. 13, 2007.

(51) Int. Cl.
*H04R 1/00* (2006.01)

(52) U.S. Cl.
USPC ..... 381/385; 381/328; 381/330; 381/381; 381/309; 381/379; 379/430; 455/575.2; 181/129; 181/130; 181/131; 181/135

(58) Field of Classification Search
None
See application file for complete search history.

(56) References Cited

U.S. PATENT DOCUMENTS

| | | | |
|---|---|---|---|
| 1,587,643 | A | 6/1926 | Harman |
| 2,474,135 | A | 6/1949 | White |
| 2,641,327 | A | 10/1953 | Balmer |
| 4,736,435 | A | 4/1988 | Yokoyama et al. |
| 4,965,838 | A | 10/1990 | Kamon et al. |
| 5,335,285 | A | 8/1994 | Gluz |
| 5,412,736 | A | 5/1995 | Keliiliki |
| 5,625,171 | A | 4/1997 | Marshall |
| 5,712,453 | A | 1/1998 | Bungardt et al. |
| 5,715,323 | A | 2/1998 | Walker |
| 5,729,615 | A | 3/1998 | Yang |
| 5,927,659 | A | 7/1999 | Yang |
| 5,953,435 | A | 9/1999 | Mullin et al. |
| 6,038,329 | A | 3/2000 | Lee |
| 6,097,827 | A | 8/2000 | Yang |
| 6,418,230 | B1 | 7/2002 | McDonald et al. |
| 6,480,612 | B2 | 11/2002 | Cho |
| 6,731,772 | B1 | 5/2004 | Byun |
| 6,771,790 | B2 | 8/2004 | Liu |
| 7,123,737 | B2 | 10/2006 | Ham |
| 7,231,056 | B2 | 6/2007 | Chen |
| 7,349,550 | B2 | 3/2008 | Oliveira et al. |
| 7,986,803 | B1 | 7/2011 | DeKalb |
| 2002/0039427 | A1 | 4/2002 | Whitwell |
| 2003/0013498 | A1 | 1/2003 | Kao |
| 2007/0036383 | A1 | 2/2007 | Romero |
| 2007/0217643 | A1 | 9/2007 | Chang |
| 2008/0298625 | A1 | 12/2008 | Prince |
| 2008/0311966 | A1 | 12/2008 | Klein |

(Continued)

FOREIGN PATENT DOCUMENTS

| | | |
|---|---|---|
| KR | 2008-97474 | 10/2008 |
| WO | WO 2007/095572 A2 | 8/2007 |

*Primary Examiner* — Duc Nguyen
*Assistant Examiner* — Taunya McCarty
(74) *Attorney, Agent, or Firm* — Wesley Schwie; Nathan Lee

(57) ABSTRACT

An adaptation device that removably attaches to earbud style headphone/s and provides security and retention of the earbud to a wearer's ear.

22 Claims, 13 Drawing Sheets

U.S. PATENT DOCUMENTS

2009/0010461 A1 1/2009 Klinghult
2009/0123016 A1* 5/2009 Rise ..... 381/380
2009/0202096 A1 8/2009 Ryann
2010/0086167 A1 4/2010 Akihiko
2010/0217103 A1 8/2010 Abdul-Hatiz
2011/0007926 A1 1/2011 Murozaki

* cited by examiner

SECTION D-D

SECTION D-D

SECTION E-E

SECTION E-E

HEADPHONE ADAPTATION AND POSITIONING DEVICE WITH MEANS FOR HOLDING AN EARBUD STEM

CROSS-REFERENCE TO RELATED APPLICATIONS

This application is a continuation of U.S. patent application Ser. No. 12/133,435 entitled Headphone Adaptation and Positioning Device, which was filed in the United States Patent and Trademark Office on Jun. 5, 2008. Patent application Ser. No. 12/133,435 incorporated by reference and claimed the benefit of U.S. provisional application No. 60/943,557, filed on Jun. 13, 2007. This application claims the benefit of patent application Ser. No. 12/133,435 and provisional application No. 60/943,557, both of which are herein incorporated by reference.

TECHNICAL FIELD

This disclosure relates to audio headphones that are worn in the ears, and more particularly, to a securing device that reduces the risk of dislodgement of the earbud from a wearer's ear.

BACKGROUND

Headphones or earphones are used by a large number of people to listen to audio from a variety of sources such as a digital music players, tapes, cell phones, radios, DVD players, and the like. Headphone are well-known in the prior art as an electro-acoustic transducer that offers simplicity, personal audio, and portability. A headphone is typically used with a single ear, using a single audio channel, and in this singular configuration is generally suited more for spoken audio than music. A headphone may also be used in tandem with both ears, and in which case are referred to as headphones. Headphones are generally better suited for listening to music, particularly in stereo or where more then one audio channel is used. Headphone/s are often worn by a wearer while simultaneously doing a variety of different activities. The physical activity level that a wearer can be engaged in while wearing a headphone/s can vary greatly, from stationary/sedentary all the way to highly vigorous extreme activities. Frequently, a significant range in physical activity levels may occur while listening to headphone/s throughout a day or other time period. For example, a wearer may use headphone/s to listen to music while lying down, then later for running or other exercise, and later while studying.

A variety of types/categories of headphone/s designs have developed over the years. One of the most popular is referred to as an earbud or an earbud-type headphone. Earbud-type headphone/s are also known as in-ear headphone/s, earbud speakerphone/s, or as canal phone/s. Earbuds are electro-acoustic transducer devices of a compact size designed to fit within the area of the concha and/or auditory canal of the external ear of a wearer so the wearer can listen to audio being transmitted from a sound source. Earbud/s are an especially popular type of headphone/s to be sold as a component of a packaged system, typically where the earbuds are sold along with a variety of different audio source devices. A particular phenomenon of this is the iPod® line digital media players produced by the Apple Computer Corporation of Cupertino, Calif. Over 100 million units of iPod media players and pairs of earbud-type headphones packaged therewith have been sold worldwide.

When properly positioned in the ear, earbud/s can provide the wearer with acceptable sound transmission to the ear audio canal. However, due to anatomical variation between ears of different wearers, and to a lesser extent ear-to-ear variation of a single wearer, earbud/s may not fit a wearer's ear/s. For some wearers, earbud/s may simply fall out, or easily fall out of the ear/s. Even a moderate increase in physical activity of a wearer will tend to exasperate poor or marginal fit between an earbud and the wearer's ear. Additionally, movement during vigorous activity can cause even a well fitting earbud to dislodge from the ear of a user resulting in distraction and annoyance to the wearer.

Consumers tend to purchase earbud/s without choice given the frequency that they come packaged with an audio device. However, there are a wide variety of non-earbud type headphone/s that can be purchased separately. Separately purchased headphone/s may indeed fit a user better and can be more suitable for use during vigorous activities than the earbud/s that come with a wearer's audio device. One type of earphone/s readily available is the ear-hook headphone that is so named from having a hook or hanger that rests behind the ear. Ear-hook headphone/s are also known as around-the-ear headphone/s, over-the-ear headphone/s, or ear-hanger style headphone and are generally considered a better choice during vigorous activity because of the more positive attachment to a wearer's ear when compared to earbud/s. There are many other headphone/s options such as the type with a band that goes over the head of a user and having a speaker that fits within the concha or a larger speaker that is placed to or over the ear.

However, having to purchase a separate headphone/s beyond the earbud/s that are packaged with a particular audio device is generally undesirable. In addition, there may be times a wearer prefers different styles of headphone/s. For example, a wearer may have a preference for an earbud-type headphone/s when studying yet prefer an ear-hook style headphone/s when exercising. Furthermore, a separately purchased earphone may not have sound fidelity and/or quality as good as the earbuds that were specifically engineered and designed to go with a particular audio source device. Finally, separately purchased earphone are less likely to match the color and/or style of the audio source device than are the original earbuds that can be designed to be a specific part of a coordinated audio system.

Thus, it is desirable to develop a device that improves the fit of earbud/s and makes them compatible with a greater range of anatomical variation and that improves the attachment of the earbud to a wearer's ear and coincidentally make the earbud more suitable for use during vigorous activity. Ideally, such a device would be attachable and removable to the earbud allowing the device to be attached to the earbud for certain activities such as exercise, yet be removable, allowing the earbud to be used on its own for other activities.

BRIEF DESCRIPTION OF DRAWINGS

Aspects and features of the as claimed invention will be appreciated and better understood by reference to the following detailed description of the embodiments of the invention when considered in connection with the accompanying drawings, wherein:

DETAILED DESCRIPTION

Figure 1:
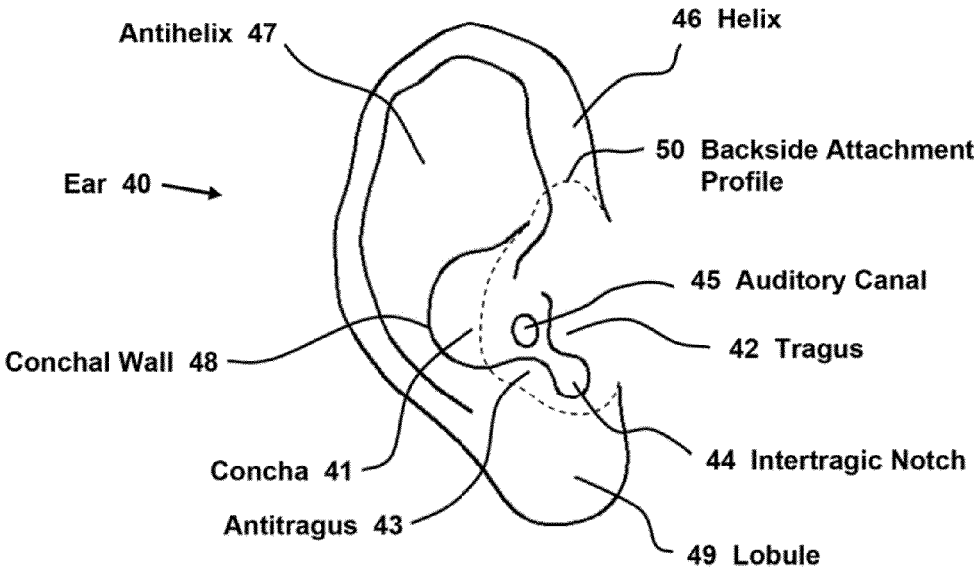
FIG. 1 illustrates anatomy of a typical human ear.

The accompanying drawings form part of the detailed description below. The drawings show specific embodiments in which the invention may be practiced, by way of example or illustration and not by way of limitation. These embodiments are described in enough detail through text and drawing figures to enable those skilled in the art to practice the claimed invention. The embodiments may be combined, other embodiments may be utilized, or structural, logical and mechanical changes may be made without departing from the scope and spirit of the claimed invention. The following description is, therefore, not to be taken in a limiting sense.

In the drawings, which are not necessarily drawn to scale, like numerals describe substantially similar components throughout the several views. The drawings illustrate generally, by way of example, but not by way of limitation, various embodiments discussed in this disclosure.

For purposes of illustration and to assist in the understanding of the respective placement of earbud type headphones of the prior art and the claimed invention, a view of a typical human ear is shown in FIG. 1. The outer ear has two general surfaces that are defined by the direction they face. There is a frontside portion that faces away from the head as shown in FIG. 1, and a backside portion that faces towards the head. The external or outer ear consists of the pinna or auricle and auditory canal 45 or meatus. The auricle is a cartilaginous member having a structure that is irregularly concave, directed slightly towards a persons anterior, and having a number of ridges and depressions. The helix 46 is the prominent external outer edge of the auricle and the antihelix 47 is contained within the outer perimeter of the helix 46. The concha 41 contains the entry to the auditory canal 45. On the anterior side, relative the greater person, and projecting backwards with a point-like eminence over the auditory canal 45 is the tragus 42. Opposite the tragus 42 is the antitragus 43 a small rounded projection. The tragus 42 and antitragus 43 are separated by the intertragic notch 44 or incisura intertragica. The concha 41 is a relatively deep and spacious cavity, the outer perimeter of this cavity is generally defined around its perimeter by the conchal wall 48, antitragus 43, tragus 42, and intertragic notch 44. At the bottom of the ear, below the tragus 42 and antitragus 43, is the lobule 49. The backside attachment profile 50, indicated with a dashed line in FIG. 1, is the approximate profile where the backside of the ear intersects with and attaches to the head.

Figure 2:
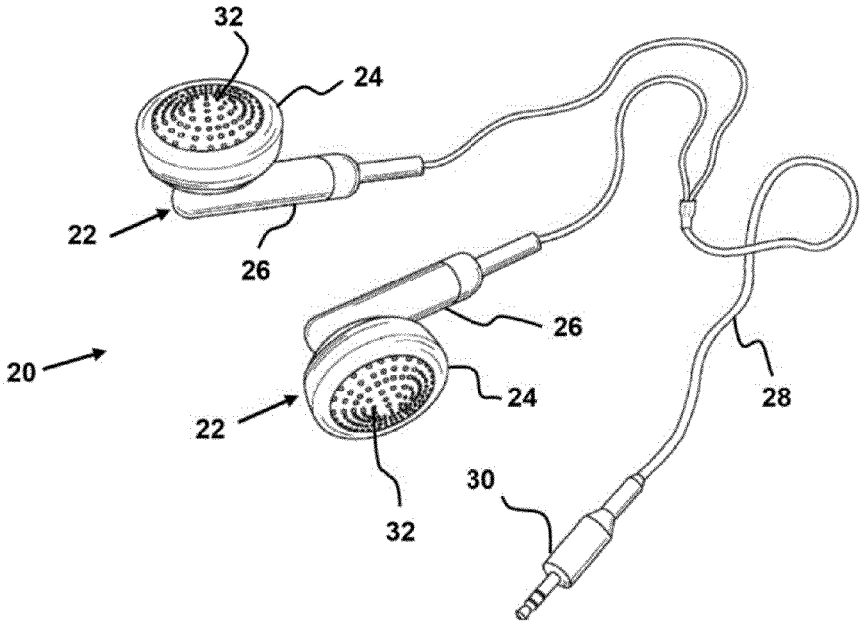
FIG. 2 (PRIOR ART)
FIG. 2 is a perspective view of a prior art earbud headphone assembly.

As additional basis to understanding the claimed invention, FIG. 2 shows a pair of earbud headphones 20 well known in the prior art. Earbud headphones typically comprise, inter alia, a plug 30 adapted to be connected to a receptacle in an audio source device, a cable 28 (also known as cord) having a predetermined length, and the earbuds 22. In the case of stereo earbuds, the cable 28 can bifurcate at some point along its length and each respective cable section can then attach to the right or left earbud 22. It should be noted that earbuds can also be wireless, in which case, the cable 28 is not present. A common type of earbud 22, as shown in this example, consists of a speaker housing 24 and a stem 26 which depends from or attaches to the speaker housing 24, the stem contains the cable 28 for each speaker and the cable exits the stem 26 at its end. The bottom of the speaker housing 24 may optionally have a speaker grate 32. Earbuds are generally worn within the concha 41 and/or auditory canal 45 of the ear of a wearer. When worn, the earbud speaker housing 24 is typically supported by the tragus 42 and antitragus 43 and concha 41 and/or auditory canal 45. The earbud is typically oriented so the stem 26 is pointed roughly downward and the stem 26 is typically positioned in the area of the intertragic notch 44. With the stem 26 positioned in the area of the intertragic notch 44, the stem 26 is generally constrained on either side by the antitragus 43 and tragus 42 both of which protrude outward relative to the intertragic notch 44.

Figure 3:
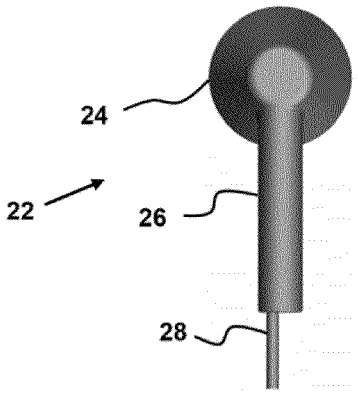
FIG. 3 (PRIOR ART)
FIG. 3 is a back-view of a prior art earbud headphone.
Figure 4:
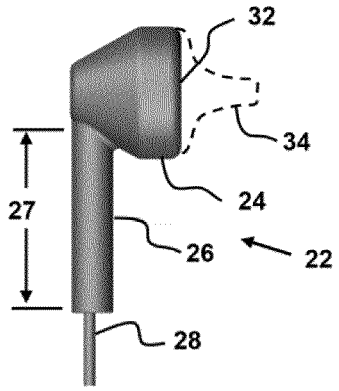
FIG. 4 (PRIOR ART)
FIG. 4 is a side-view of a prior art earbud headphone.

Reviewing further detail of earbud shape and form, FIGS. 3-4 show back and side-views of an example prior art earbud of the type having a speaker housing 24 and a stem 26. The earbud speaker housing 24 outer perimeter is commonly generally circular in its outer profile as shown best in the view of FIG. 3. When worn in the typical manner, the outer perimeter of the housing of the earbud is constrained by the concha 41 cavity and/or the auditory canal 45 in which the earbud speaker fits, and more particularly, can be constrained by the space available in the conchal area between the conchal wall 48, antitragus 43, and tragus 42. The bottom of the earbud speaker housing can consist of a speaker surface or grate 32, an exemplary side-profile of which is shown in FIG. 4. Differing from that shown, the bottom of the earbud speaker housing in the area of grate 32 can be concave or convex. The bottom or grate 32 portion of the earbud generally rests at the bottom of the concha and typically covers or extends into a portion of the auditory canal 45. An earbud stem 26, is typically an elongated cylindrical structure having a length 27, the stem typically depends from or attaches to the speaker housing 24 at an angle therefrom. Other shapes for the cross-section of the stem 26 other than a circle are also common such as oval, triangular, square, or other cross-sectional shape profile. The cross-sectional shape of the stem 26 can also vary in cross-sectional shape along the stems elongated length 27 from any combination of different shapes. The stem 26 may also follow a trajectory along its length 27 that is straight or that has one or more curves and/or changes. The stem 26 is a common but optional feature of an earbud 22, if the stem 26 is not present then the cable 28 can depend directly from the speaker housing. Canal phone/s are another type of prior art headphone that are closely related in design to earbud/s. Canal phones can have an extending structure 34 that extends at least partially into the auditory canal 45. The extending structure 34 is shown with a dashed line for illustrative purposes in FIG. 4, the structure of canal phones to that of earbuds may otherwise be similar. The as claimed invention relates to both earbud/s and/or canal phone/s. As used herein, the term earbud or earbud-type headphone refers generically to both earbuds and canal phones.

Figure 5:
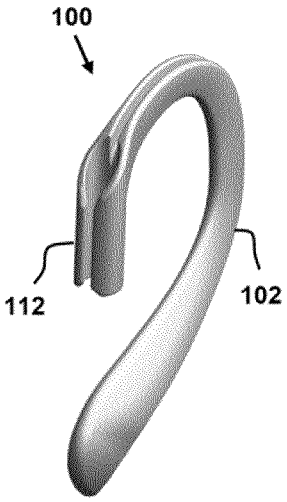
FIG. 5 is a perspective view of an adaptation device in accordance with an embodiment of the claimed invention.
Figure 6:
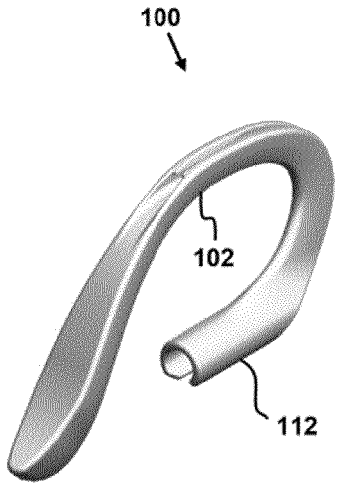
FIG. 6 is an additional perspective view of the adaptation device of FIG. 5.
Figure 7:
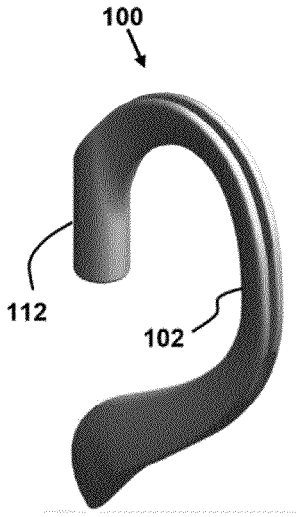
FIG. 7 is another perspective view of the adaptation device of FIG. 5.
Figure 8:
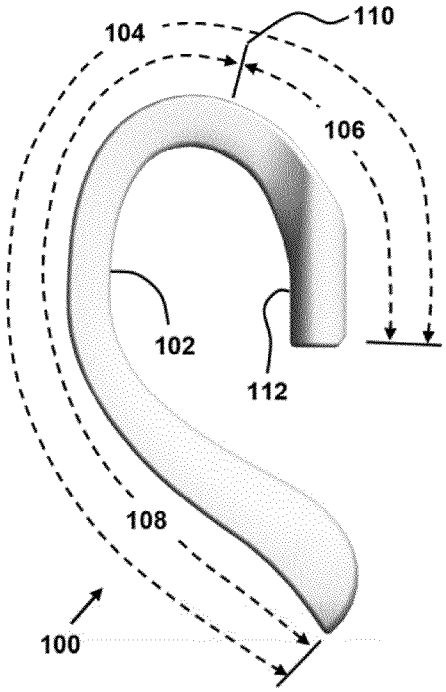
FIG. 8 is a side-view of the adaptation device of FIG. 5.
Figure 9:
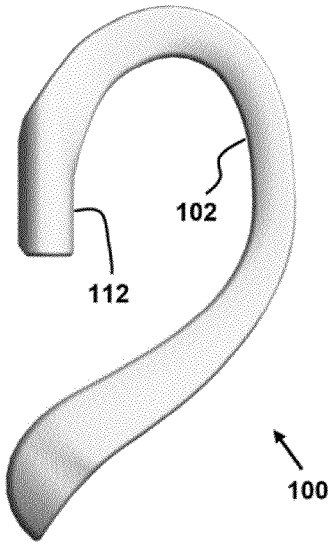
FIG. 9 is a side-view of the opposite side of the adaptation device shown in FIG. 8.
Figure 10:
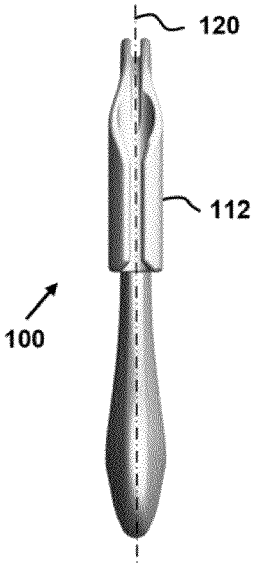
FIG. 10 is a front-view of the adaptation device of FIG. 5.
Figure 11:
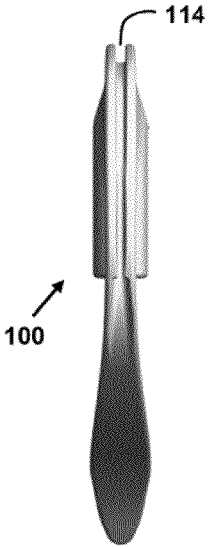
FIG. 11 is a back-view of the adaptation device of FIG. 5.
Figure 12:
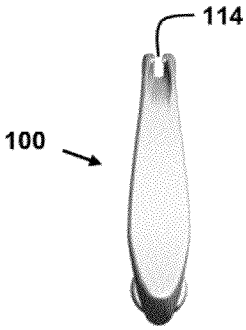
FIG. 12 is a bottom-view of the adaptation device of FIG. 5.
Figure 13:
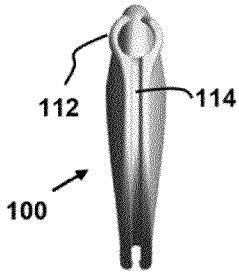
FIG. 13 is a top-view of the adaptation device of FIG. 5.

FIGS. 5-13 are differing views of one embodiment of an earbud adaptation device 100. FIGS. 5-7 are differing perspective views, FIG. 8 and FIG. 9 are respective right-side and left-side views, FIG. 10 and FIG. 11 are front and back views, and FIG. 12 and FIG. 13 are bottom and top views. The preponderant structure of the adaptation device 100 of this embodiment is a hook 102 and a C-clamp 112 which depends from or is attached to the hook 102. As shown in FIG. 8 and FIG. 9, the right-side and left-side of the adaptation device 100 are preferably a symmetric or mirrored structure about the center line 120 of the device as indicated in FIG. 10. This allows for a single substantially symmetric design that accommodates both left and right earbuds and for placement with/to both a wearer's right and left ears. As will be reviewed in greater detail later in the detailed description, the hook structure of the adaptation device includes a groove 114 therein for acceptance of an earbud cable.

Figure 14:
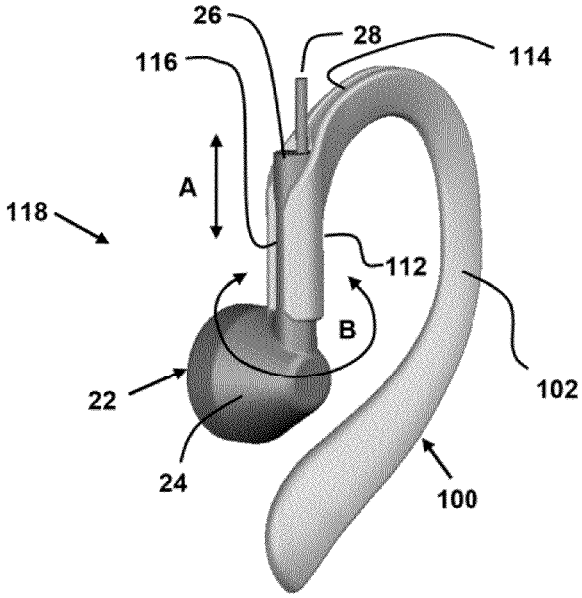
FIG. 14 is a perspective view showing an adaptation device assembly with use of the adaptation device of FIG. 5 coupled with an earbud.
Figure 15:
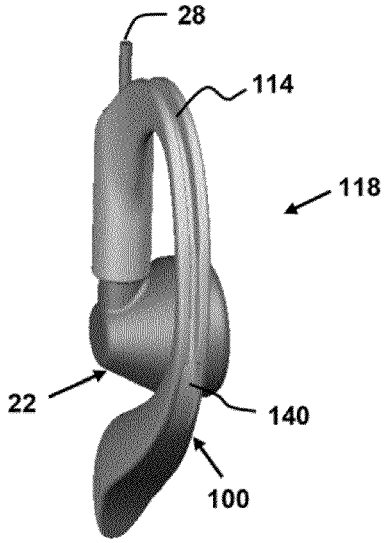
FIG. 15 is a perspective view showing the adaptation device assembly of FIG. 14.
Figure 16:
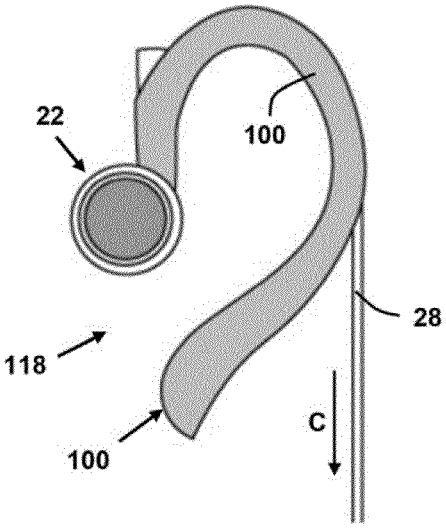
FIG. 16 is a side-view showing the adaptation device assembly of FIG. 14.
Figure 17:
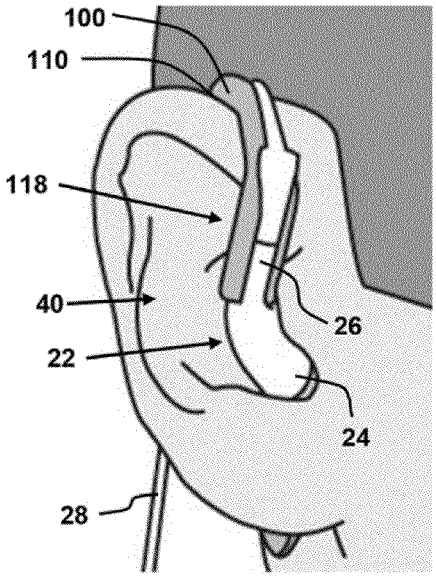
FIG. 17 is a perspective view showing the adaptation device assembly of FIG. 14 as it can be worn on the ear of a wearer.

Moving now and in reference to FIGS. 14-17 to the use of the adaptation device 100 of FIGS. 5-13 when coupled with an earbud 22. FIGS. 14-15 are differing perspective views of an earbud adaptation assembly 118 created by coupling an earbud to the adaptation device. FIG. 16 is a side-view illustration of the same earbud adaptation assembly 118 and FIG. 17 is a perspective illustration of the same assembly as it can be worn on the ear of a wearer. The earbud 22 is installed/coupled to the adaptation device by holding the earbud upside-down and matching the stem 26 up with the slit opening 116 of the C-clamp 112. The C-clamp 112 is made of material having elastic properties thereby allowing it to spread apart to accept the earbud stem 26, where the stem 26 is then held by the same elastic properties of the C-clamp 112 of the adaptation device 100. As shown in FIG. 14, the C-clamp 112 of the adaptation device allows for both axial A and rotational B adjustability of the earbud speaker housing 24 relative to the hook 102. The axial A and rotational B adjustability is achieved by applying force to the earbud that overcomes the hold of the C-clamp 112 to the earbud stem 26, the earbud speaker housing 24 can then be positioned to axial A and rotational B positions that provide for an optimal fit of the adaptation device assembly 118 to the ear 40 of a wearer.

After satisfactory positioning of the earbud stem 26 within the C-clamp 112, the next step in creating the earbud adaptation assembly is to install the earbud cable 28 within the groove 114 of the adaptation device. In FIGS. 14-15 the earbud cable 28 is shown truncated for simplification of the view and is not shown installed to the groove 114. To install the earbud cable 28 within the groove 114 the cable 28 is simply positioned over the groove 114 and then pressed into and/or pulled into the groove 114. Starting from the C-clamp 112 area where the cable 28 exits the earbud stem 26, the cable 28 can be pressed into the groove 114 by working from the frontside of the hook to the backside of the hook. Definition of the frontside and backside areas of the hook will be reviewed later in the specification in reference to FIG. 8 and FIG. 24 and accompanying text. A finger can be used for pressing the cable 28 into the groove 114. Alternatively, and in lieu or in combination with pressing, the cable 28 can be pulled in the general direction indicated by C in FIG. 16 in order to seat the cable 28 within the groove 114.

FIG. 17 shows a perspective illustration of the earbud adaptation assembly 118 as it can generally be worn on the ear 40 of a wearer/user. To install the adaptation device assembly 118 to the ear 40, the earbud speaker housing 24 can be placed within the concha of the wearer's ear and the hook 102 of the adaptation device 100 can be placed up and over the helix so that it wraps around to the backside of the ear. The order of attachment can also be reversed or done simultaneously. As shown in FIG. 14, the axial A and rotational B position of the earbud stem 26 can be adjusted relative to the hook 102 so that the earbud speaker housing 24 can be positioned to fit most comfortably when the assembly 118 is worn on the ear 40. Additionally, axial A and rotational B adjustment can be utilized to optimize the position of the earbud speaker housing 24 relative to the antitragus 43 and tragus 42 within the concha 41 as well as how snug the hook is to the helix 46 in the area that the hook 102 goes over helix 46. Both axial A and rotational B adjustment of the earbud stem 26 within the C-clamp 112 can occur either before the assembly 118 is installed to the ear 40 or while the assembly 118 is installed to the ear 40. As worn in the general manner shown in FIG. 17, the earbud stem 26 is not positioned in the area of the intertragic notch 44 as it generally would be if the earbud 22 were being worn without the adaptation device 100. Rather, the earbud 22 is held roughly upside-down relative to the wearer's ear 40 by the adaptation device 100. The term right-side-up refers to the earbud 22 orientation wherein the stem 26 is pointing roughly downward relative to a wearer's ear 40 when the wearer is standing or upright. The term right-side-up is so named herein as it is descriptive of the general orientation an earbud 22 has when worn by a wearer in a typical fashion and without the use of the adaptation device. Conversely, the term upside-down in reference to earbud 22 orientation is wherein the stem 26 points roughly upward relative to a wearer's ear 40.

Figure 18:
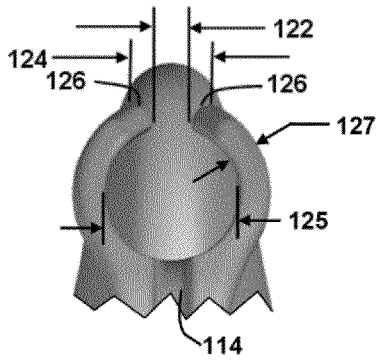
FIG. 18 is a top-view close-up of the C-clamp feature of the adaptation device of FIG. 13.

Reviewing now, in further detail, the C-clamp 112 of the adaptation device of FIGS. 5-17. FIG. 18 is a enlarged detail view of the C-clamp area of the adaptation device shown in FIG. 13. The C-clamp structure elastically deforms to removably accept the stem 26 of an earbud 22. As shown in FIG. 18, the C-clamp inner profile or gripping surface profile of this particular embodiment is generally circular. A generally circular shape allows theoretically infinite rotational adjustability between the stem of the earbud and the C-clamp's gripping surface. The C-clamp diameter 125 is preferably smaller than the diameter, or greatest width dimension, of the earbud stem's cross-section in order to ensure the C-clamp 112 provides adequate holding force to the stem 26. When the stem 26 is installed to the C-clamp 112, the C-clamp 112 stretches or elastically deforms to accommodate the stem 26 as well as to provide adequate holding or clamping force to the stem 26. The clamping force is generated because the C-clamp inner profile width is larger in at least one direction when the stem is inside the C-clamp than the C-clamp inner profile width is without the stem inserted. Thus the force imparted by the stem on the C-clamp to expand the C-clamp acts as a clamping force to hold the stem in place. In some embodiments, the C-clamp may be elastically stretchable because the C-clamp is generally flexible or because the inner profile of the C-clamp is flexible as is the case in an embodiment where the outside of the C-clamp is rigid but the inside of the C-clamp is comprised of compliant foam. Adjustments to the parameters, for example, the modulus/durometer of the C-clamp material, the C-clamp's structural wall thickness 127, the C-clamp diameter 125, and the extent that the clamp structure wraps around the stem can be adjusted in order to modify the holding force that the C-clamp 112 exerts on the stem 26. The same parameters can be adjusted to allow the C-clamp 112 to accommodate different earbud models that may have different size or diameter stems allowing the C-clamp 112 to adequately hold a variety of different earbud stems 26.

Preferably, the C-clamp 112 wraps greater than 180 degrees around the earbud stem 26 when the stem 26 is installed in the C-clamp 112 in order to provide adequate holding or gripping of the stem 26. The C-clamp entrance can optionally have a chamfer or lead-in area 126 that is defined by having an opening lead-in width 124 that is wider than an inner width 122 in the area of the C-clamp opening, the lead-in area 126 that is created from this arrangement helps provide for easier installation of the earbud stem 26 to the C-clamp 112. In another embodiment, the C-clamp 112 inner surface can include nubs, ribs, dimples, a roughened surface, or other surface features to increase friction and therefore aid the C-clamp 112 in gripping or holding the earbud stem 26. The C-clamp gripping surface, or surface features applied to the gripping surface, can consist of a different material in the gripping area than the rest of the adaptation device 100. The different material can be softer or harder, have a greater coefficient of friction, or can have other properties that help it increase grip with an earbud stem 26. Different from that shown in FIGS. 5-17 and described previously, the C-clamp 112 of the adaptation device 100 can have a profile or gripping surface that is non-circular. It can be preferable to match the clamping surface profile of the C-clamp 112 with that of the cross-sectional shape of the earbud stem 26. For example, if there is an earbud having a square shaped cross-sectional profile stem then the C-clamp 112 of the adaptation device can have a generally matching square shaped gripping or clamping profile. Similarly, and as a further example, if the cross-sectional shape of the earbud is D-shaped then the adaptation device inner profile shape of the C-clamp can have a generally matching D-shape. Additionally, for earbuds having a stem that is tapered or otherwise variable in cross-section size or shape along the stem length 27, the C-clamp of the adaptation device can have a gripping or clamping profile that generally matches that of the earbud stem.

Figure 19:
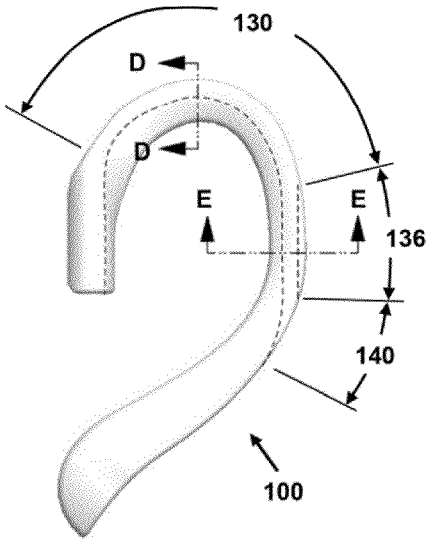
FIG. 19 is a side-view of the adaptation device of FIG. 5 with hidden lines that illustrate the groove feature and different sections through the device.

Delving into further detail of the groove 114 feature of the adaptation device 100, FIG. 19 is a side view of the adaptation device of FIGS. 5-17 with hidden lines that represent an example path that the groove can define within the structure of the adaptation device 100. As the hidden lines show, the groove follows the outer radius of the adaptation device hook structure from the C-clamp area at the frontside of the hook to the backside portion of the hook. Definition of the frontside and backside areas of the hook will be reviewed later in the detailed description in reference to FIG. 8 and FIG. 24 and accompanying text. The groove is preferably placed on the outside radius of the hook rather than on the sides of the hook where the groove could be more likely to irritate the wearer's head or the backside of the wearer's ear. In this example, there are three different areas of the groove feature, a parallel groove area 130, a retaining groove area 136, and a groove exit area 140 where the earbud cable exits the device.

Figure 20:
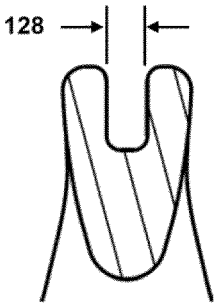
FIG. 20 is a section view showing section D-D from FIG. 19.
Figure 21:
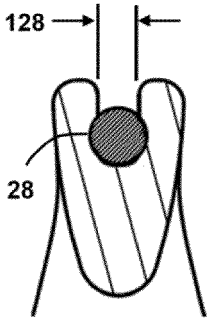
FIG. 21 is a section view as in FIG. 20 but with a cable shown.

The parallel groove area 130 is shown in FIG. 20 that is a section view of D-D from FIG. 19. FIG. 21 is a similar view to that of FIG. 20 but with the earbud cable 28 shown for explanatory purposes as it would be installed to the groove. In the parallel groove area 130 of the adaptation device are two generally parallel wall sections that define a groove or trough there-between. Preferably, as shown in FIG. 21, the groove width 128 in the parallel groove area 130 is smaller than the diameter of the earbud cable 28, this provides an interference fit to help removably hold the cable 28 to the adaptation device 100. The term "parallel groove" to describe area 130 is not limited to literally/actually being parallel, rather, what is specifically implied/meant by the term "parallel groove" is that the opposed structure in this area of the hook is sufficiently parallel in that it is able to provide fit with and generally hold a cable 28.

Figure 22:
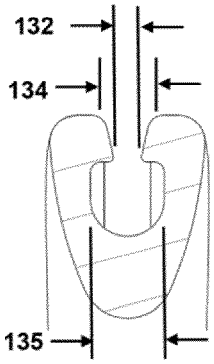
FIG. 22 is a section view showing section E-E from FIG. 19.
Figure 23:
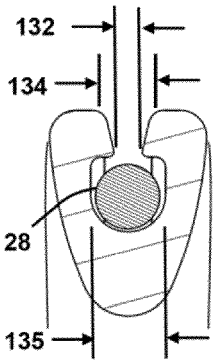
FIG. 23 is a section view as in FIG. 22 but with a cable shown.

The retaining groove area 136 is shown in FIG. 22 and is a section view of E-E from FIG. 19. FIG. 23 is a similar view to that of FIG. 22 but with the earbud cable 28 shown as it would be installed within the groove. The adaptation device in the retaining groove area 136 has generally opposed and parallel walls having a first width 135. Additionally, there is structure that protrudes inward toward-one-another, shown at the top portion of the view, and that corresponds to the side of the device that defines the hooks general outer radius, the inward protruding area has a second width 132 or retaining groove width that is preferably smaller than the diameter of the cable 28 in order to provide a retaining structure for the cable 28. As an alternative to that shown in FIGS. 22-23, the structure of the inward protruding area that defines the second width 132, can be inward protruding from a single side (rather than inward protruding toward-one-another) or be unequally protruding from each respective opposed side. The first width 135 is preferably the same size or larger than the diameter or width of the cable 28. In another embodiment, the first width 135 can be smaller than the cable diameter. There can also be a retaining groove lead-in width 134 that is preferably larger than the second width 132 in order to provide ease of installation of the cable 28 to the groove. Although it is preferable in the parallel groove area 130 to have an interference fit between the groove and the cable, no interference between the groove and the cable is necessary in the parallel groove area 130 given the retention that is provided to the cable in the area of the retaining groove area 136.

The groove exit area 140 provides a transition and/or strain relief area for the cable to exit the retaining groove area 136. The groove exit area 140 is preferably equal or larger diameter than the earbud cable diameter or width. The adaptation device structure in the groove exit area 140 preferably fans outward as shown generally in FIG. 15. The groove exit area 140 provides a relief area that allows the cable to be fully seated within the parallel groove area 130 and retention groove area 136 when the cable is pulled in the general direction indicated by C in FIG. 16. Pulling on the cable to fully seat it within the groove can be in combination or in lieu of pressing the cable into the groove. Additionally, the groove exit area 140 allows a wearer or user to visualize if the cable is fully seated within the groove.

Figure 24:
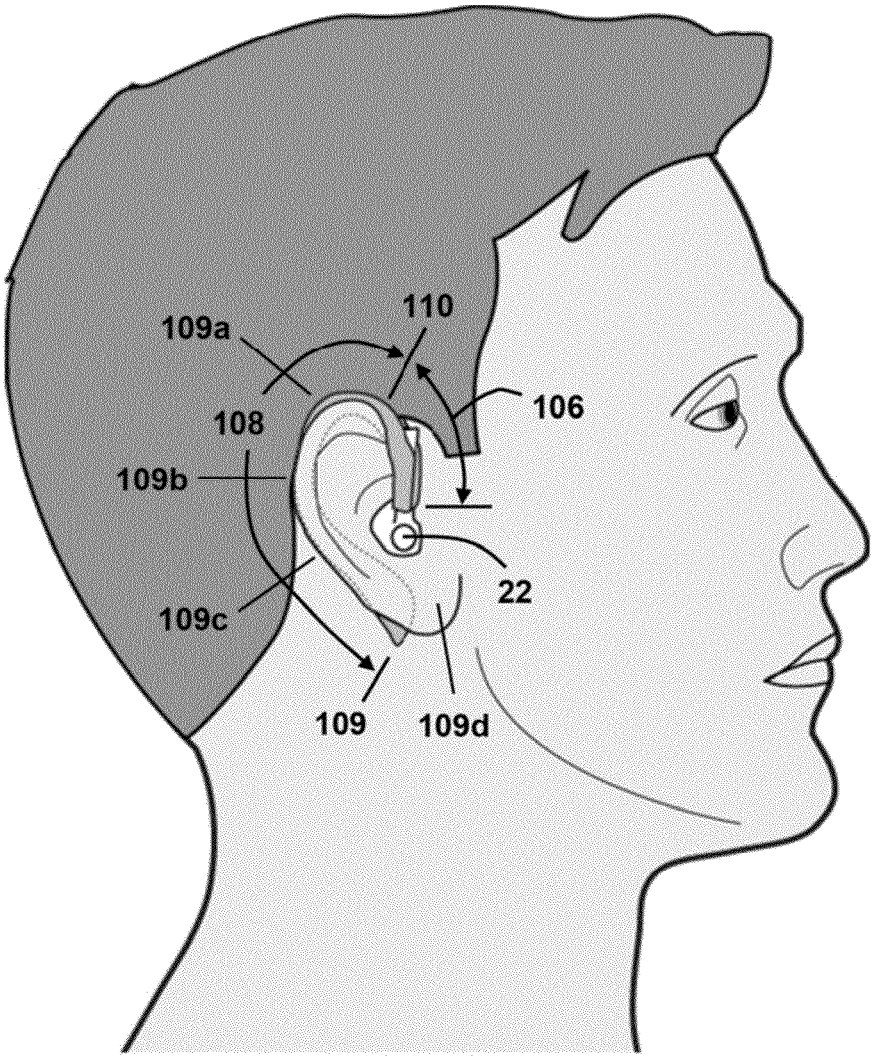
FIG. 24 is a side-view of the adaptation device assembly of FIG. 14 coupled to the ear of a wearer.

With reference to FIG. 8 and FIG. 24, the hook structure that allows for placement on a wearers ear will be explained in additional detail. The structure of the greater hook profile 104 consists of a frontside portion 106 that is shaped for positioning on the frontside of a wearers ear and a backside portion 108 shaped for positioning on the backside of the ear auricle and having a termination point 109 or end. The frontside portion of the hook 106 includes a means for holding an earbud, for example a C-clamp. When worn, the backside portion of the hook 108 is generally constrained between the backside of the auricle and the wearer's head and wraps around the backside of the ear generally abutting or near the attachment profile of the ear to the wearer's head. The profile of the backside portion of the hook 108 hidden by the ear is shown with dashed lines in FIG. 24. The backside portion 108 of the hook 102 wraps around the backside of the ear to provide positional stability to the earbud adaptation assembly 118. The backside portion of the hook 108 can end 109 at any area on the backside of the ear. In different embodiments, 109*a*, 109*b*, 109*c*, and 109*d* are other exemplary end or termination points for the backside portion of the hook 108. It can be preferable that the termination point 109 end on the backside of the ear in order to allow the hook to fit a greater number of wearers and accommodate a greater amount of anatomical variation. The less the hook wraps around the backside of the ear, for example 109*a*, then the less stability that may be provided but the greater anatomical variation the adaptation device is generally able to accommodate. In comparison, termination point 109 can provide more stability but may have less ability to accommodate anatomical variation. Terminating on the backside of the ear is herein defined in that the hook does not further wrap around from the backside attachment profile 50 such that the hook goes all the way around again to the frontside of the ear. The transition point 110 is exemplary in nature as a way to describe the general function of the overall hook structure and the general location where the frontside portion of the hook 106 transitions to the backside portion 108 and how the hook is generally sized and shaped to accommodate placement on the frontside of a ear and to wrap around to the backside of the ear. The actual transition point 110 will vary by ear anatomy and by adjustment of the earbud stem relative the adaptation device.

The adaptation device can be constructed out of a polymer material or other material. Preferably, the device is constructed out of a elastomer that has a hardness in the range of 35 to 99 shore A durometer. More preferably, the device is constructed out of an elastomer in the range of 70 to 90 shore A durometer. Example elastomers that can be used for construction of the adaptation device include silicone elastomer or PVC (polyvinyl chloride) elastomer. The device can also be constructed out of multiple different materials that can correspond to different respective sections of the hook and be tailored to the performance needs of the respective section. Additionally, different levels of hardness or durometer that correspond to different respective sections of the device can be used allowing the hardness/stiffness to be tailored to the needs of the respective section.

As described above, one means for holding the stem 26 of an earbud 22 is a C-clamp 112. The C-clamp of the adaption device is preferably constructed out of a polymer with elastomeric properties that allow the opening of the C-Clamp 112 to stretch apart and thereby removably accept the stem portion of an earbud 26. Additionally, the C-clamp 112 provides adequate clamping force to the stem 26 of the earbud to allow adjustment of the earbud and to hold the earbud's position relative to the hook 102 of the adaptation device 100. In one embodiment, the C-clamp is constructed out of an elastomer material that is the same elastomer material used in the construction of the rest of the adaptation device, namely, the frontside portion of the hook 106, the backside portion of the hook 108, and the overall hook 104.

In one embodiment, the adaptation device can have a inner skeleton construction where there is a more rigid polymer structure that is partially or fully encapsulated by a softer material, the structure of the inner skeleton can be adjusted to allow the properties to be tailored for different areas of the device. The inner skeleton can also be a metal wire structure that is deformable to allow for user customized shaping of the hook portion of the device. The construction technique for the adaptation device is preferably a molding operation. Additional and generally equivalent or substitute choices in material and construction make-up of the device are possible.

FIGS. 25-42 show differing perspective and detail views of various alternative means, other than the above described C-clamp 112, for holding the stem 26 of an earbud 22 to the hook structure of the adaptation device. Of all the differing means for holding the earbud stem that will be reviewed, it is preferable that there is provision for axial and rotational adjustment of the earbud stem 26 relative to the hook. Generally, the following adaptation device embodiments can be constructed using similar material/s and general techniques to that of the aforementioned device, albeit, the following may have variations for the specific stem holding means and other variations.

Figure 25:
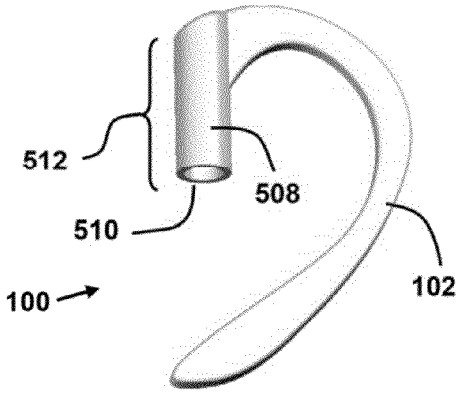
FIG. 25 is a perspective view of an alternative embodiment adaptation device having a generally cylindrical structure.
Figure 26:
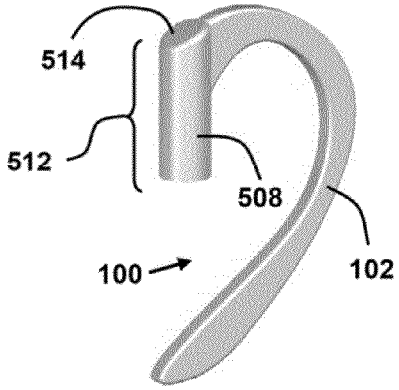
FIG. 26 is an additional perspective view of the adaptation device of FIG. 25.

In FIGS. 25-26 there is a generally cylindrical structure 508 having an opening 510 for accepting an earbud stem and with section length 512 for coupling with and gripping the earbud stem 26. The cylindrical structure 508 is dependent from or attached to the hook 102 of the adaptation device 100. As shown in FIG. 26, the end of the cylindrical structure 514 can be closed, or alternatively from that shown, the opening 510 can extend all the way through the cylindrical structure 508. Compliant material is used for the cylindrical structure 508, thereby allowing the structure to stretch to removably accept the earbud stem 26, the compliant material can be an elastomer such as silicone or another material. The cylindrical structure 508 allows for rotational and axial adjustment of the stem 26 by adjustably positioning the stem 26 within the section length 512 of the adaptation device 100. This embodiment can be preferred for earbuds that are wireless in design and therefore do not have a cable. For earbud/s with a cable 28, the cable 28 can be folded downward wherein the cable 28 is held along-side the earbud stem 26 by the cylindrical structure 508, the cable 28 then exits the same opening 510 that both the stem 26 and cable 28 were inserted into. Optionally, the cable can hang from the frontside of the wearer's ear similar to as if the earbuds are worn on their own. The cable 28 can also be routed over and behind the ear if the cylindrical structure 508 is open at its end 514, in this embodiment the earbud can be installed to the adaptation device by stretching the compliant material over either the earbud speaker housing or over the earbud plug and/or the other earbud pair.

Figure 27:
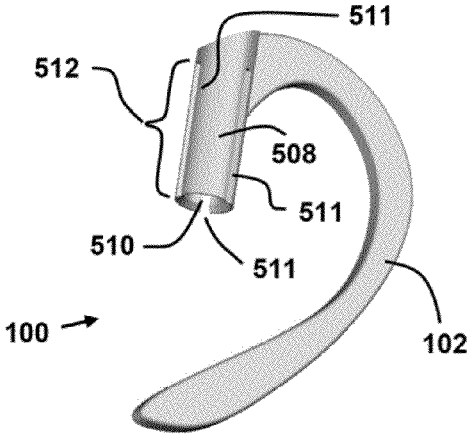
FIG. 27 is a perspective view of an alternative embodiment adaptation device having a generally cylindrical structure with slits.

FIG. 27 is an additional embodiment having a cylindrical structure 508 with one or more elongated slits 511 therein. The slits 511 allow the cylindrical structure 508 to expand for acceptance of an earbud stem 26 and to provide a compressive force to removably hold the earbud stem 26. The earbud cable can exit the cylindrical structure 508 from either end of the cylinder or through a slit 511. Different from that shown there can be more or fewer slits. Also different from that shown, the slits 511 can alternate originating from opposite ends of the cylindrical structure or other variation thereof.

Figure 28:
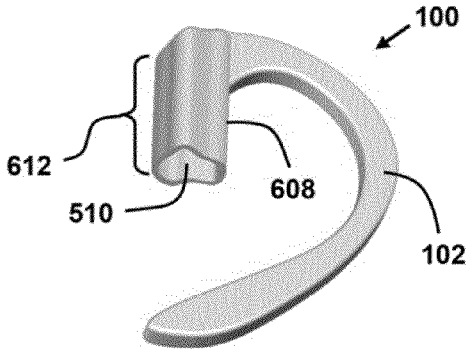
FIG. 28 is a perspective view of an alternative embodiment adaptation device having a non-cylindrical structure.

In FIG. 28 the clamp structure for holding the earbud stem is a non-cylindrical structure 608, the non-cylindrical embodiment could be constructed out of similar materials. The non-cylindrical embodiment functions in a similar fashion to the cylindrical embodiment, there is a opening 510 for accepting an earbud stem and with a section length 612 for coupling with the earbud stem 26 and that allows for axial and rotational adjustability. The non-cylindrical perimeter of the structure can have an undulating or wave-like perimeter. The non-cylindrical perimeter can have the advantage of accepting earbud stems of greater variety such as different or varying cross-sectional shapes or simply different diameter or widths than a simple cylindrical structure. For earbuds having a cable 28, the non-cylindrical perimeter can have the advantage of providing a relief area/s for the cable to be folded over and wherein it is held alongside the stem.

Figure 29:
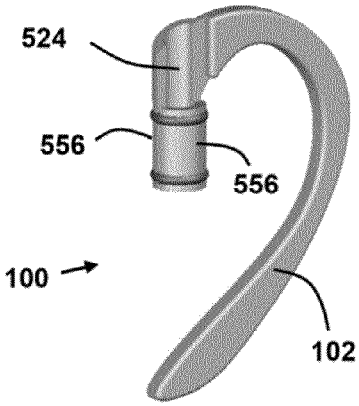
FIG. 29 is a perspective view of an alternative embodiment adaptation device having clamp segments.
Figure 30:
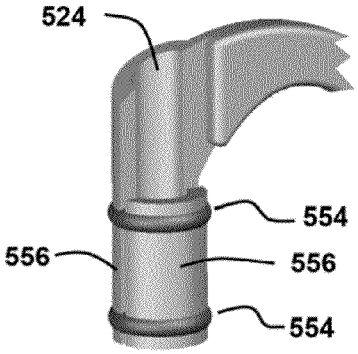
FIG. 30 is a detail view of the clamp segment area of FIG. 29.

The perspective view of FIG. 29 shows an additional embodiment having a plurality of generally circumferential clamp segments 556 either dependent, attached, or held to the hook 102. FIG. 30 is a detail view of the circumferential clamp segments 556, in this example, there are two opposed clamp segments held by bands 554 that allow the clamp segments to provide generally radial force the earbud stem 26. The bands 554 are constructed out of a substantially elastic material to allow the clamp structure to stretch apart to accommodate a variety of earbud stems and to provide adequate clamping force for holding yet allowing for axial and rotational adjustment as well as removability of the stem. Different from that shown, there can be greater than two clamp segments, additional clamp segments may be preferred for earbud stems with non-round stem cross-sectional shapes or to accommodate a greater number of earbud designs. Not shown, there can be a hybrid design that is some combination of the embodiment in FIG. 27 having slits and that of the embodiment of FIG. 29 where there is a least one band, the band providing assistance to the cylindrical structure with slits to provide generally radial clamping force.

Figure 33:
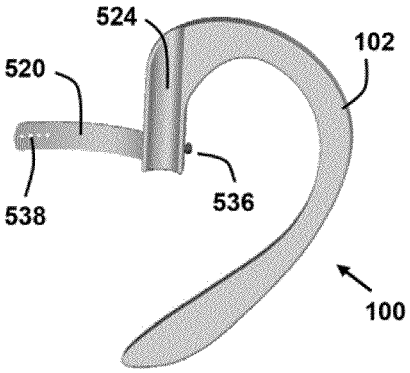
FIG. 33 is a perspective view of an alternative embodiment adaptation device having a strap secured by a button or peg.
Figure 34:
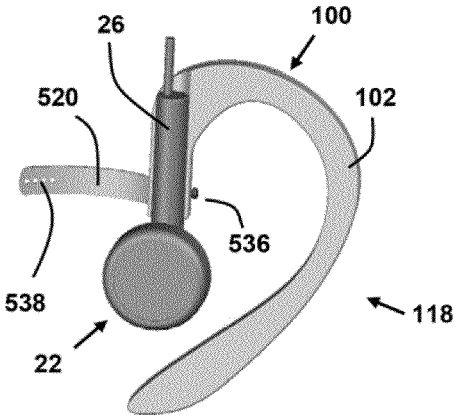
FIG. 34 is a perspective view showing an alternative embodiment adaptation device assembly with use of the adaptation device of FIG. 33.
Figure 35:
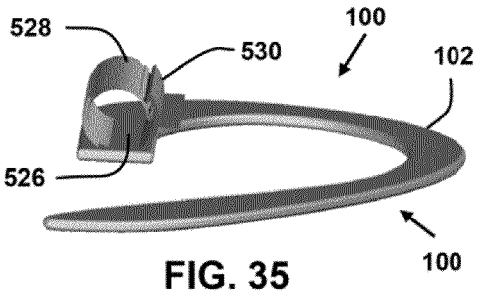
FIG. 35 is a perspective view of an alternative embodiment adaptation device having arms.

FIGS. 31-36 are various views of embodiments having means of a strap, arm, or flap that wraps around the earbud stem 26 in order to couple it to the hook 102. In these embodiments the frontside portion of the hook has structure in an area to couple with the stem 26 that can be generally flat 526 as shown in the embodiment of FIG. 35, or the hook structure can define a general trough shape 524 as in the embodiment of FIG. 31 and FIG. 33. Both the flat and trough embodiments, or some combination or modification thereof, work in combination with a strap 538 or arm 528 that secures the earbud stem against the flat 526 or trough 524 area of the adaptation device. The earbud stem is positioned against the flat 520 or trough 524 and the strap 520 or arm 528, attached to the structure on one side of the trough/flat wraps over at least a portion of the earbud stem 26 and attaches to an area on the opposite side of the trough/flat, thereby securing the earbud stem 26 to the adaptation device 100. Similar to as in the aforementioned C-clamp 112 embodiment, the design of the present alternative means also allows for axial and rotational adjustment of the earbud stem relative to the adaptation device.

Figure 31:
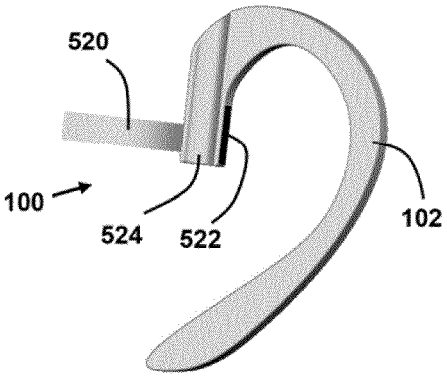
FIG. 31 is a perspective view of an alternative embodiment adaptation device having a strap.
Figure 32:
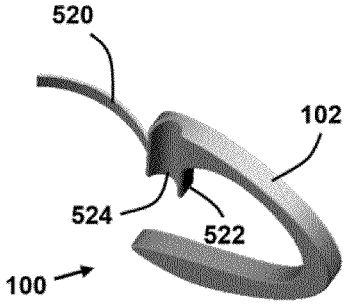
FIG. 32 is an additional perspective view of the adaptation device of FIG. 31.
Figure 36:
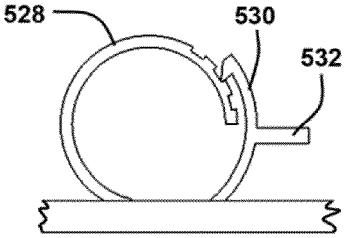
FIG. 36 is a detail side-view of the arms area of the adaptation device of FIG. 35.
Figure 37:
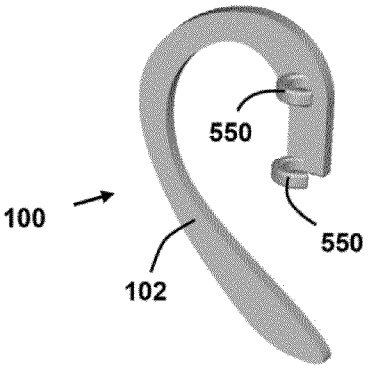
FIG. 37 is a perspective view of an alternative embodiment adaptation device having clips.
Figure 38:
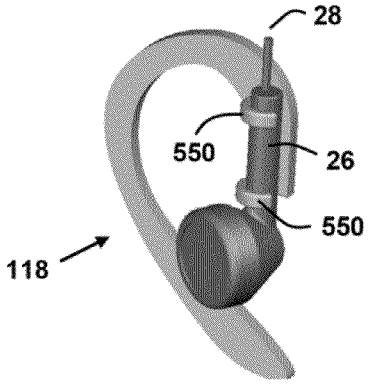
FIG. 38 is a perspective view of an alternative embodiment adaptation device assembly with use of the adaptation device of FIG. 37.
Figure 39:
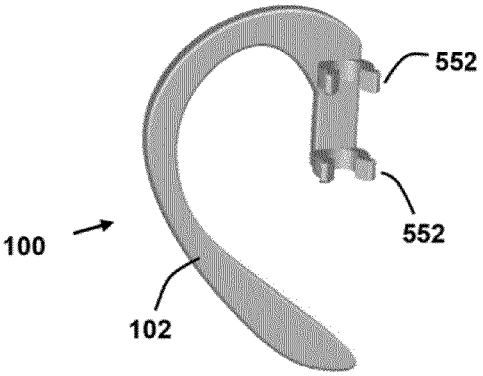
FIG. 39 is a perspective view of a further embodiment adaptation device having a pair of clips.
Figure 40:
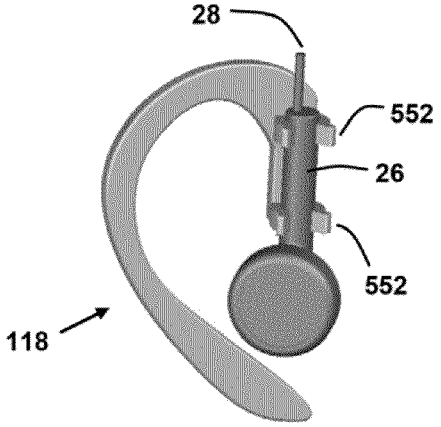
FIG. 40 is a perspective view of an alternative embodiment adaptation device assembly with use of the adaptation device of FIG. 39.

In FIGS. 31-32 the strap is secured with a hook-and-loop or burr type faster system. The hook-side of the hook-and-loop faster can be attached to the end of the strap 520 and the mating or corresponding loop-side portion can be applied to the adaptation device structure at an area to either side 522 of the trough 524, or vise versa. In FIGS. 33-34 the strap is secured with some combination of a button or peg 536 and hole 538 type fastener. As shown, there can be a series of holes allowing for adjustability. Not shown, there could instead be a series of buttons or pegs 536 to accomplish the same. In FIG. 35 a arm or strap 528 with a gear rack structure prevents the strap from opening unless the user activates the release mechanism. The release mechanism moves a ratchet arm or strap 530 away from a gear rack arm or strap 528. FIG. 36 is a detail side-view of the gear rack and ratchet mechanism of FIG. 35. The earbud is secured in place by the gear rack or groove arm 528 in combination with the ratchet arm or strap 530. The ratchet tooth engages the gear racks groove or gear tooth to removably clamp the earbud stem 26. The release mechanism handle 532 moves the ratchet tooth away from the gear rack when the user depresses the release mechanism allowing the stem 26 to be removed from the adaptation device 100.

There exists numerous other equivalent methods to secure a strap or arm, either initiating from one of either side of the device and securing to the opposite side of the device or where the strap or arms initiate from both sides of the device and then secure to one another. The strap or straps could also be secured by many other means, either on their own or in combination, including by way of non-limiting example, cable tie, gear rack in combination with a ratchet, snap, tie, interlocking structures, clips, tape, springs, magnets, friction fit, adhesive, buckle, bolt, and equivalent or similar.

Figure 41:
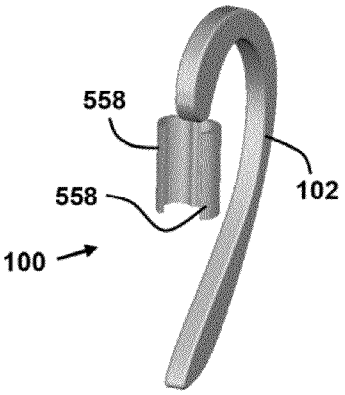
FIG. 41 is a perspective view of another embodiment of an adaptation device having a spring clamp.
Figure 42:
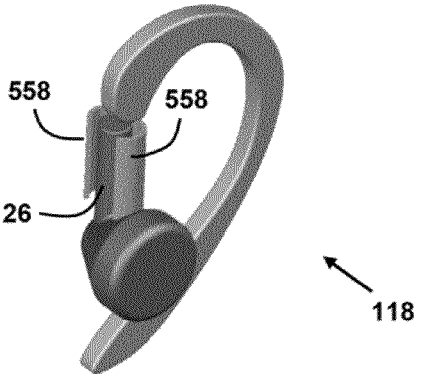
FIG. 42 is a perspective view of an alternative embodiment adaptation device assembly with use of the adaptation device of FIG. 41.

Further means for the adaptation device to hold the earbud by the stem 26 are shown in FIGS. 37-42. The embodiment of FIGS. 37-38 use a one-sided clip 550 in a pair/set as a means to removably attach to the earbud stem 26. Alternatively, the embodiment shown in FIGS. 39-40 uses opposed clips 552 for removably securing the earbud stem 26. The clips can be an integral component of the hook 102 and constructed out of the same material or can be a different material such as metal or can be a separate component that is attached to the hook 102. In FIGS. 41-42 spring clamps 558 are used as the means to attach the earbud stem 26 to the adaptation device. The spring clamps 558 can hinge at a point and use spring force to hold the earbud stem 26. In both FIGS. 41-42 the spring clamps 558 are illustrated in an open position. Installation of the earbud stem can require that the spring clamps 558 be stretched apart from a lower energy position to a higher energy position in order to accommodate the earbud stem 26 or, in another embodiment, the spring clamps 558 can toggle between two low energy positions for the closed and open positions.

Figure 43:
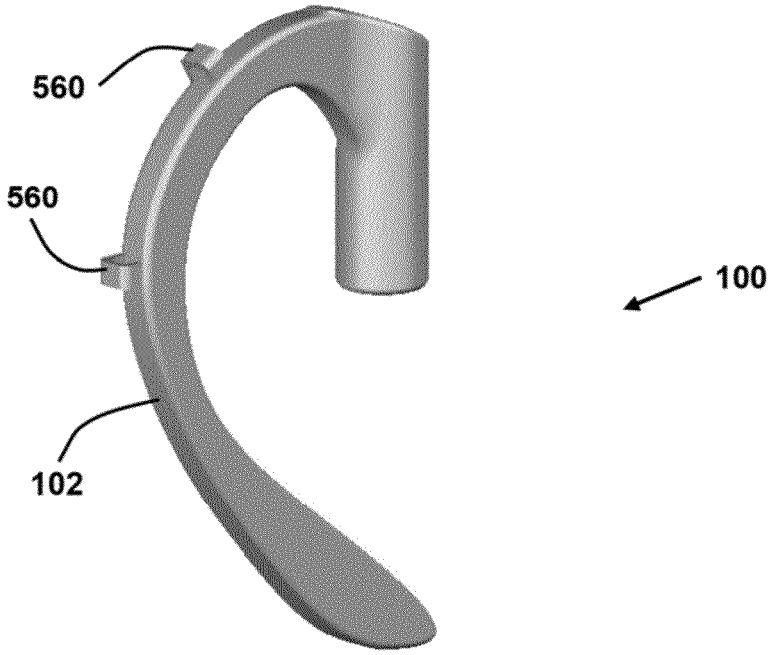
FIG. 43 is a perspective view of an alternative embodiment adaptation device having cable clips.
Figure 44:
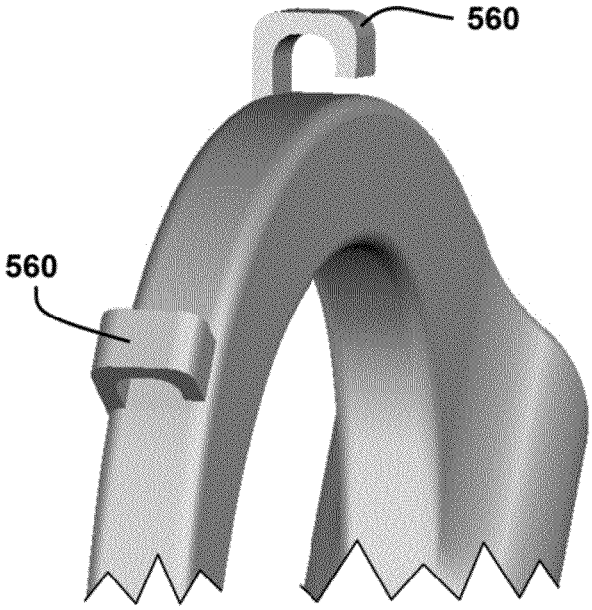
FIG. 44 is a detail view of the cable clips area of the adaptation device of FIG. 43.

All of the alternative embodiments shown in FIGS. 25-42 have been for exemplary purposes simplified to focus on describing alternative means for the adaptation device 100 to hold the earbud stem 26. A means for cable management is therefore not shown in FIGS. 25-42 although it is preferred that the embodiments shown in those figures and accompanying text have a means for cable management. More general to all embodiments herein, in actual reduction to practice and if the earbud/s are not wireless, then it is preferred that the adaptation device have a means for managing the earbud cable. One way of managing the cable is to have a cable management means for removably attaching the cable to at least a portion of the hook structure and wherein the cable is then routed over and along at least a portion of the backside of a wearers ear. The aforementioned description associated with the embodiment in FIGS. 19-23 having a series of groove profiles 130, 136, 140 for accepting a cable 28 is one example means for cable management. Different from that described, the hook structure can have a simple groove where the cable is pressed or wedged into the groove. The groove can also be positioned on a side of the hook structure for acceptance of the cable rather then on the outer radius edge as previously described. An alternative to a groove means for removably accepting the cable is shown in FIG. 43 where there is one or more cable clips 560 provided for accepting the cable. FIG. 44 is an enlarged view of the clips 560 introduced in FIG. 43, the clips 560 can stretch or flex to accept the cable or the cable itself can be compressed to be accepted by clips 560 that are generally rigid. Not shown, there can be more or less than two cable clips 560 and the clips 560 can also be opposed pairs in structure for acceptance of the cable between the opposed clips. There are many other equivalent means for removably securing the cable to the hook of the adaptation device, including by way of non-limiting example, wires, clasps, adhesives, cable tie, straps, interlocking structures, or equivalent or similar. The means for managing the cable is generally preferably positioned on the outside radius of the hook, depending on the specific means, rather than on the sides of the hook, this is to avoid irritating the wearer's head or the backside of the wearer's ear.

When compared to how an earbud would be worn by itself, the afore described adaptation device embodiment generally provides additional positional stability for the earbud speaker relative to the wearer's ear. When worn with the afore described adaptation device, the earbud is held by the adaptation device approximately upside-down. Additionally, the earbud speaker cable, if present, preferably hangs from the backside of the ear, assisted by a cable management means, rather than from the frontside of the ear as it would hang when the earbud is used by itself and worn in a typical manner. Similar to how when the earbud is worn by itself, the adaptation device allows the speaker housing 24 to be generally supported within the concha 41 by the antitragus 43 and tragus 42 that protrudes upward and help to hold the earbud speaker housing 24 within the concha 41. This allows the earbud 22 coupled with the adaptation device to be positioned substantially the same distance and position within the concha 41 and relative the auditory canal 45 of a wearer as if the earbud 22 were worn by itself. This allows similar sound quality and delivery both when the earbud/s is worn on-its-own or with the adaptation device and helps preserve the sound fidelity that the earbud/s are designed and engineered to provide.

The adaptation device also provides additional stability to the earbud by way of the hook structure that is positioned between the helix and head around the backside of the ear. With the adaption device then, the earbud is supported not only by the antitragus 43 and tragus 42 but also by the hook structure around at least a portion of the backside of the ear. The additional stability provided by the adaptation device helps reduce risk of dislodgement of the earbud from a wearer's ear. However, of significant advantage when compared to around the ear style headphone, is the removable nature of the adaptation device that allows the earbud to be worn on-its-own or else with the adaptation device, depending on the level of activity a wearer may expect to be engaged in.

Figure 45:
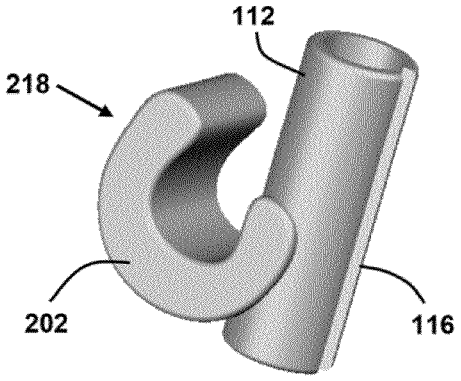
FIG. 45 is a perspective view of an alternative embodiment adaptation device.
Figure 46:
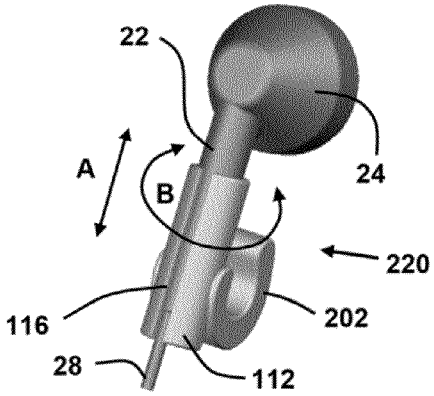
FIG. 46 is a perspective view of an alternative embodiment adaptation device assembly with use of the adaptation device of FIG. 45.
Figure 47:
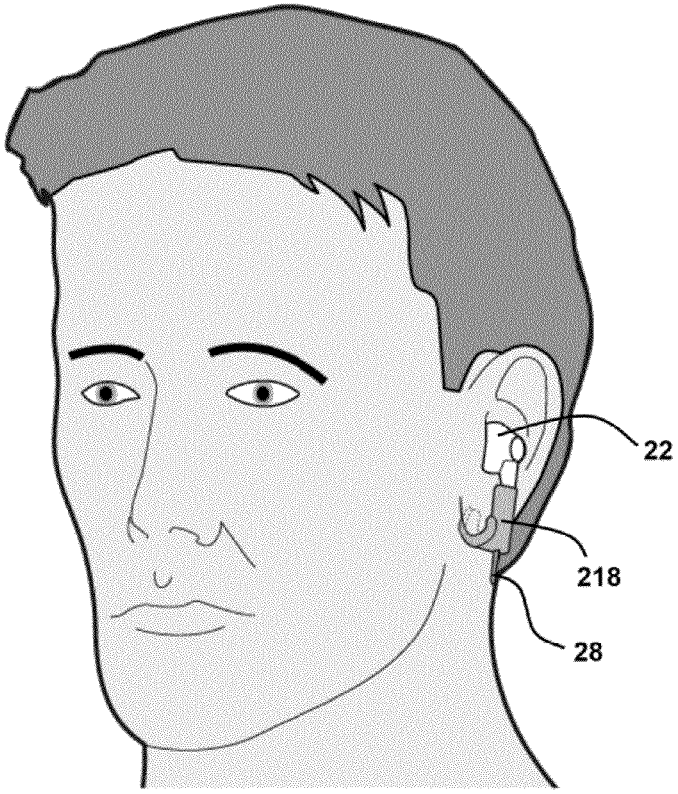
FIG. 47 is a perspective view showing the adaptation device assembly of FIG. 46 as it can be worn on the ear of a wearer.
Figure 48:
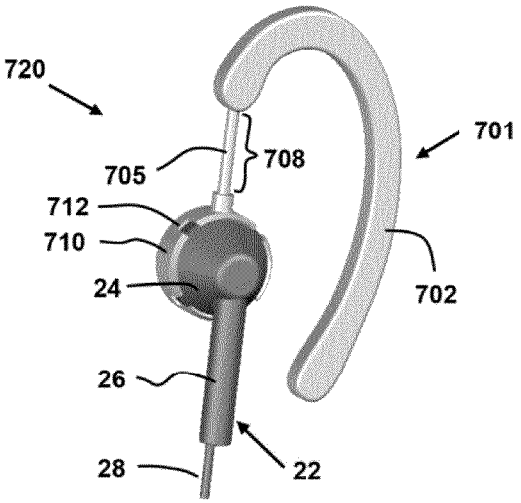
FIG. 48 is a perspective view showing an alternative embodiment adaptation device assembly where the earbud is held by the speaker housing.

An additional embodiment to that of the foregoing embodiments of the headphone adaptation device is shown in FIGS. 45-47, where the adaptation device 218 is configured to be secured with a hook 202 that wraps to the backside of the ear lobule 49. The hook 202 of the adaptation device 218 is sized and shaped for placement in the general area of a wearer's ear lobule 49. The hook 202 has a frontside portion for placement on the frontside of a wearer's ear and a backside portion. The dashed outline in FIG. 47 indicates roughly the backside hook portion of the device that wraps around to the backside of the wearer's ear. The transition between the frontside portion of the hook and the backside portion will vary based on user anatomy but is intended to describe the structure of the hook as it relates to its general function in this embodiment. There can be a C-clamp 112 that is dependent or attached from the frontside portion of the hook 202, the C-clamp 112 functions similar to the above embodiment of FIGS. 5-17 in that it removably accepts the earbud stem 26 and allows for axial A and rotational B personalized adjustment of the position of the earbud speaker housing 24 relative to the wearers concha 41 and other anatomy. The slit 116 of the C-clamp 112 allows for the earbud cable 28 to fit through its opening in order to provide ease of installation to the adaptation device 218. As shown in FIG. 47 the adaptation of this particular embodiment orients the earbud right-side-up with the stem 26 pointing roughly downward and the cable routed downward in a manner generally similar to how the earbud and cable would be worn without the adaptation device 218 of this embodiment. In the adaptation device 218 of this embodiment, as described previously in the detailed description, there can be a number of other means for grasping the earbud stem 26 other than a C-clamp 112.

Figure 52:
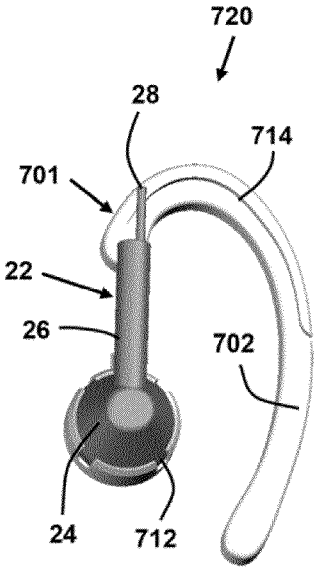
FIG. 52 is a perspective view showing an alternative embodiment adaptation device having a groove.
Figure 53:
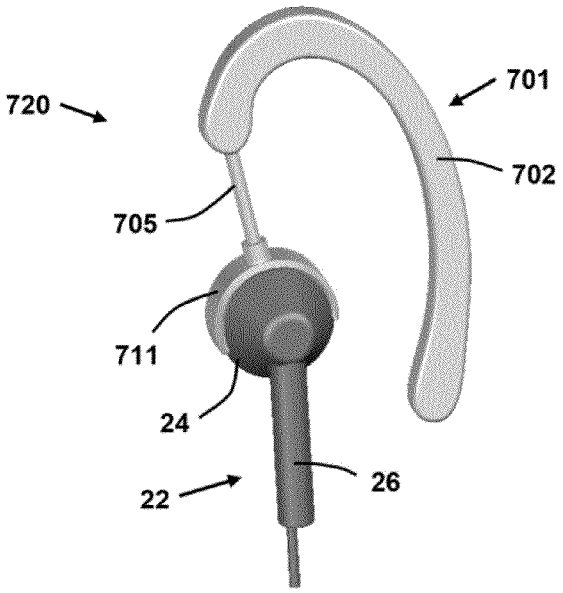
FIG. 53 is a perspective view shown an alternative embodiment adaptation device assembly where the earbud is held by the speaker housing.

Further alternative embodiments are shown in FIGS. 48-53 wherein the earbud adaptation device 701 holds the earbud 22 by the speaker housing 24 rather than by the stem 26. This can be the preferred embodiment for earbuds that have a stem 26 structure/shape that is difficult to hold or for earbuds where the stem is not present and the cable 28 depends directly from the speaker housing 24. The hook 702 of the adaptation device 701 can have a strut 705 that forms an integral part of at least the frontside portion of the hook 702 structure, the strut 705 can be constructed out of metal or polymer and is preferably constructed out of a metal wire that is deformable or bendable allowing for wearer customization. The strut 705 can extend within the hook as a skeleton type structure that provides support for a softer or more compliant polymer cover or jacketing or can be dependent from or attached to the remainder of the hook structure 702. As shown, the strut 705 can have an exposed portion 708 where it is not covered or encapsulated by the softer or other material. In an embodiment different from that shown, the strut 705 can be entirely encapsulated or covered by the softer or other material. Dependent from or attached to the strut 705 is structure that forms a receptacle 710 for removable acceptance of the earbud speaker housing 24. The strut 705 is an optional feature of the hook 702, if the strut 705 is not present then the receptacle is directly dependent from or attached to the hook 702 itself. The structure of the receptacle 710 is sized and shaped to surround and capture the outer perimeter of the earbud speaker housing 24. The structure of the receptacle 710 is constructed out of material that is flexible or stretchable allowing the receptacle to removably accept the outer perimeter of the earbud speaker housing 24 and also provides adequate force to prevent the earbud 22 from being generally unintentionally removed from the adaptation device 701. The receptacle 710 can optionally have one or more relief groove/s 712 within the structure of the receptacle to help the receptacle stretch or flex to accept the earbud speaker housing 24. An alternative receptacle 711 to that of receptacle 710 is shown in FIG. 53 wherein the receptacle 711 couples with only a portion of the outer perimeter of the of the earbud speaker housing 24. Preferably, the alternative receptacle 711 surrounds greater than 180 degrees of the earbud speaker housing 24 perimeter. Different from that shown, the receptacle structure can be non-continuous where it can consist of a plurality of contact points to hold the earbud speaker housing 24 perimeter and where the contact points are attached/dependant to the strut 705 and/or hook 702.

An earbud adaptation assembly 720 is created when the earbud speaker housing 24 is installed within the receptacle 710/711 of the adaptation device 701. Upon installation to the adaptation device 701, the speaker housing 24 is rotationally adjustable within the receptacle and the earbud stem 26 can correspondingly be positioned in any radial direction. Shown in FIGS. 48-51 and 53, the earbud is positioned generally right-side-up as indicated by that the stem 26 is roughly downward facing similar to how it would typically be worn without the adaptation device 701, also similar, the earbud stem 26 can be positioned in the area of the intertragic notch of the wearer and the cable can hang roughly downward. Alternatively, as shown in FIG. 52, the earbud can be positioned generally upside-down wherein the stem roughly points upward relative to the wearer. In this embodiment there can be a cable management means, similar to that described in the foregoing, for routing the cable behind the ear of the wearer. As shown in FIG. 52, there is structure within the hook 702 of the adaptation device 701 that defines a groove 714 therein for removably accepting the earbud cable 28. The groove 714 shown in FIG. 52 is positioned on the side of the hook 702 as an exemplary alternative embodiment, the preferred position for the groove is on the outside radius of the hook, as previously described related to FIGS. 19-23 and accompanying text. The cable 28 is shown not attached to the groove 714 for simplification purposes of the view and to allow the groove 714 of FIG. 52 to be more fully shown.

Figure 49:
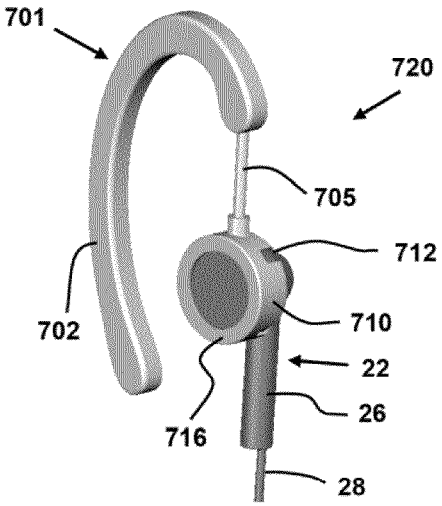
FIG. 49 is an additional perspective view of the assembly of FIG. 48.
Figure 50:
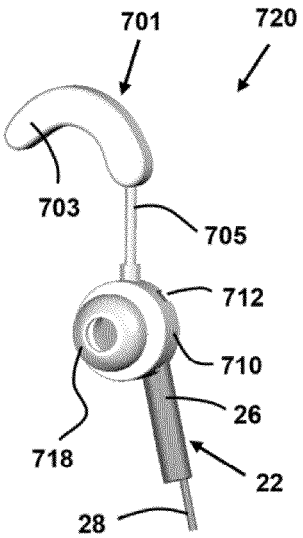
FIG. 50 is a perspective view showing an alternative embodiment adaptation device assembly having an earpiece.
Figure 51:
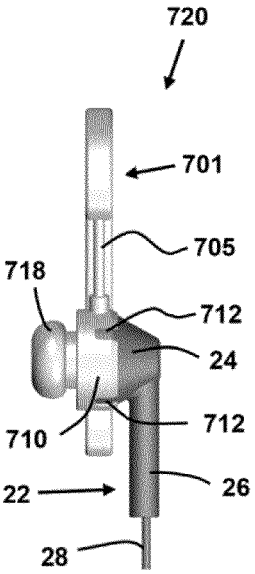
FIG. 51 is a side view showing an additional alternative embodiment adaptation device assembly having an earpiece.

In reference to FIG. 49, the bottom portion of the receptacle 710 can have a thin section 716 where the adaptation device preferably provides minimal additive structure to the bottom portion of the earbud speaker housing 24. It is beneficial to have a thin section 716 of material in this area of the adaptation device 701 so the earbud 22 when worn with the adaptation device 701 can be positioned close to a similar distance relative the ear canal of the wearer as the earbud would otherwise be in if the earbud 22 were worn without the use of the adaptation device 701. This allows the earbud's as designed sound quality/fidelity to be generally maintained when worn with the adaptation device 701. In the alternative embodiment shown in FIGS. 50-51, the receptacle 710 of the adaptation device 701 can have an earpiece 718 that acts to seal and/or cushion the bottom of the earbud speaker area of the adaptation device assembly 720 against the concha 41 and/or auditory canal 45. The earpiece 718 can be constructed out of silicone elastomer or other material and can be a dependent component of, or attached to, the receptacle 710 of the adaptation device 701. Preferably, the earpiece 718 is sized and shaped so that the earbud speaker housing 24 can be positioned a similar distance relative the ear canal of the wearer to that if the earbud 22 were worn by itself. The hook 702 and 703 of the different alternative embodiment adaptation devices in FIGS. 48-52 is similar in structure to that described related to FIG. 8 and FIG. 24 and accompanying text. As such, the backside portion of the hook can end at different lengths as illustrated by the example hook 702 in FIGS. 48-49 and the example hook 703 in FIG. 50.

Figure 54:
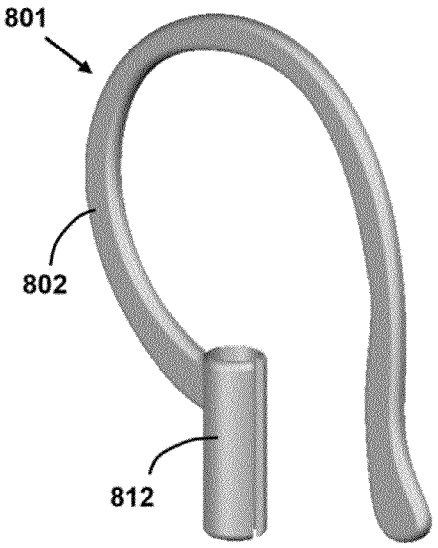
FIG. 54 is a perspective view of an alternative embodiment adaptation device for holding an earbud right-side-up.
Figure 55:
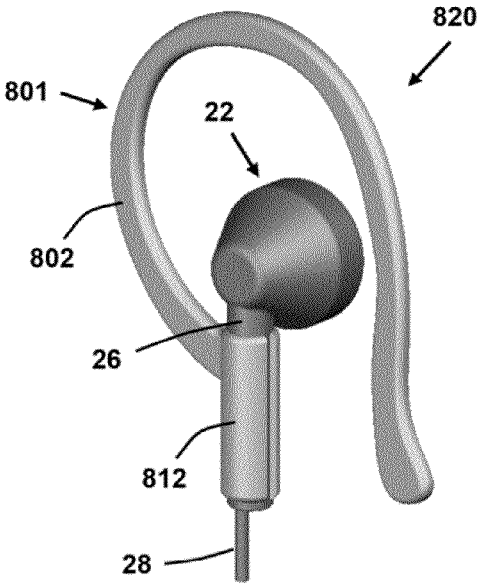
FIG. 55 is a perspective view of an alternative embodiment adaptation device assembly using the adaptation device shown in FIG. 54.

An additional alternative embodiment adaptation device 801 is shown in the perspective views of FIGS. 54-55 wherein the earbud is held right-side-up. The structure, function, and adjustability of the alternative adaptation device 801 is similar to that of the adaptation device 100 in FIGS. 5-17 and accompanying text but with the hook 802 and C-clamp 812 sized and shaped for orienting the earbud stem 26 roughly downward so the earbud 22 is held right-side-up in the adaptation device assembly 820 relative to the wearer's ear. In this manner, the C-clamp 812 and stem 26 held within the C-clamp 812 can be generally positioned in the area of the intertragic notch 44 when the adaption device 820 is coupled to a wearer's ear. It is preferable in this embodiment that the hook structure 802 where the C-clamp 812 is attached/dependant from the hook not be positioned so that the attachment point is inward facing towards the wearer's ear. This is to avoid irritation of the ear and also to maintain positioning of the earbud speaker within the general area of the concha and/or auditory canal that is similar to the position the speaker would be in relative to the concha and/or auditory canal if the earbud were worn without the adaptation device.

The above description is intended to be illustrative, and not restrictive. For example, the above embodiments (and/or aspects thereof) may be used in combination with each other. Many other embodiments will be apparent to those skilled in the art after reading the above description. While the foregoing written description of the invention enables one of ordinary skill to make and use the claimed invention, those of ordinary skill will understand and appreciate the existence of variations, permutations, combinations, equivalent means, and equivalents of the specific embodiments, methods, and examples herein. The invention should therefore not be limited by the above described embodiments, methods, and examples, but by all embodiments and methods within the scope and spirit of the invention as claimed.

I claim:

1. An adaptation device for an earbud headphone, comprising:

a hook having a frontside portion and a backside portion, wherein the frontside portion of the hook is configured to position the earbud substantially upside-down relative to a wearer's ear and to position a speaker of the earbud generally over the auditory canal and generally within the concha and/or the auditory canal of the ear, and wherein the backside portion of the hook is configured to hook over the top of the helix to the backside of the wearer's ear along the backside of the auricle; and a holding means for holding an earbud headphone by an earbud stem, wherein the holding means is located on the frontside of the hook, wherein the holding means is configured to securely yet removably receive the earbud stem, and wherein the holding means is configured to allow the earbud stem to be positioned at an axial location along the earbud stem, whereby the holding means is able to receive the earbud stem by sliding a distal end of the earbud stem, relative to the speaker, into a distal end of the holding means, whereby the earbud stem and the holding means are substantially coplanar.

2. The adaptation device as in claim 1 wherein the holding means for the earbud stem is configured to provide rotational adjustment of the earbud.

3. The adaptation device as in claim 1 wherein the adaptation device is of a single substantially symmetric design that allows for mounting to either a wearer's right or left ear and accepts a right or left earbud speaker.

4. The adaptation device as in claim 1 wherein the adaptation device is constructed of an elastomeric material.

5. An adaptation device for an earbud headphone, comprising:

a hook having a frontside portion and a backside portion, wherein the frontside portion of the hook is configured to position the earbud substantially upside-down relative to a wearer's ear and to position a speaker of the earbud generally over the auditory canal and generally within the concha and/or auditory canal of the ear, and wherein the backside portion of the hook is configured to hook to the backside of the wearer's ear along the backside of the auricle; and a clamp located on the frontside portion of the hook, wherein the clamp is configured to securely yet removably receive an earbud stem, and wherein the clamp is configured to allow the earbud stem to be positioned at an axial location along the earbud stem, whereby the clamp is able to receive the earbud stem by sliding a distal end of the earbud stem, relative to the speaker, into a distal end of the clamp, whereby the earbud stem and the clamp are substantially coplanar.

6. The adaptation device as in claim 5 wherein the clamp for the earbud stem is configured to provide rotational adjustment of the earbud.

7. The adaptation device as in claim 5 wherein the adaptation device is of a single substantially symmetric design that allows for mounting to either a wearer's right or left ear and accepts a right or left earbud speaker.

8. The adaptation device as in claim 5 wherein the clamp is elastically stretchable to accommodate installation and/or removal of the stem and to generate a clamping force to hold the stem when the stem is installed within the clamp.

9. The adaptation device as in claim 5 wherein the adaptation device is constructed of an elastomeric material.

10. An adaptation device for an earbud headphone, comprising:

a hook having a frontside portion and a backside portion, wherein the frontside portion of the hook is configured to position the earbud substantially upside-down relative to a wearer's ear and to position a speaker of the earbud generally over the auditory canal and generally within the concha and/or auditory canal of the ear, and wherein the backside portion of the hook is configured to hook over the top of the helix to the backside of the wearer's ear and along the backside of the auricle; and a clamp located on the frontside portion of the hook, wherein the clamp is configured to securely yet removably receive the earbud stem, wherein the clamp is elastically stretchable to accommodate installation and/or removal of the stem and to generate a clamping force to hold the stem when the stem is installed within the clamp, and wherein the clamp is configured to allow the earbud stem to be positioned at an axial location along the earbud stem, whereby the clamp is able to receive the earbud stem by sliding a distal end of the earbud stem, relative to the speaker, into a distal end of the clamp, whereby the earbud stem and the clamp are substantially coplanar.

11. The adaptation device as in claim 10 wherein at least a portion of the adaptation device is constructed of an elastomeric material.

12. The adaptation device as in claim 10 wherein the adaptation device is of a single substantially symmetric design that allows for mounting to either a wearer's right or left ear and accepts a right or left earbud speaker.

13. The adaptation device as in claim 10 wherein the clamp provides for axial and rotational adjustment of the earbud's stem within the clamp, whereby there is adjustability to accommodate a wide range of anatomical variations among different wearers or differences between a wearer's left and right ear.

14. The adaptation device as in claim 10 wherein the clamp's inner profile is generally circular.

15. The adaptation device as in claim 10 wherein the attachment between the frontside of the hook and the clamp is not located on the side of the clamp that is inward facing towards the wearer's ear, whereby irritation of the wearer's ear is prevented, further wherein the earbud's position within the concha and/or auditory canal when worn with the adaptation device is substantially similar to the earbud's position within the concha and/or auditory canal when worn without the adaptation device.

16. A method for using an adaptation device in conjunction with an earbud headphone comprising the steps of:

providing an earbud headphone;

providing an adaptation device having a hook, wherein the hook has a frontside portion for placement on the frontside of a wearer's ear and a backside portion for hooking to the backside of the ear that terminates on the backside of the ear, wherein the adaptation device has a holding means located on the frontside of the hook for holding the earbud headphone, and wherein the adaptation device is configured to receive a speaker housing of the earbud within the concha and/or auditory canal of the wearer's ear; and attaching the earbud to the holding means of the headphone adaptation device by either the earbud's stem or by the earbud's speaker housing, wherein the holding means is configured to securely yet removably receive the earbud's stem or the earbud's speaker housing, wherein the holding means is configured to allow the earbud-stem to be positioned at an axial location along the earbud stem, whereby the holding means is able to receive the earbud stem by sliding a distal end of the earbud stem, relative to the earbud's speaker housing, into a distal end of the holding means, whereby the earbud stem and the holding means are substantially coplanar, and wherein an earbud headphone adaptation assembly is created.

17. The method as in claim 16 wherein the provided earbud is of the variety having a stem and the adaptation device holding means holds the earbud by the earbud's stem and the earbud being in a substantially upside-down orientation relative to the wearer's ear when the earbud is attached to the adaptation device.

18. The method as in claim 16 wherein the provided earbud has a cable and the hook of the adaptation device has structure that defines a groove therein for receiving the cable and further comprising the step of attaching the cable of the earbud within the groove of the adaptation device.

19. The method as in claim 16 further including the step of attaching the head phone adaptation assembly to a wearer's ear.

20. The method as in claim 16 wherein the adaptation device is temporarily coupled to the earbud yet is removable, allowing the earbud to be used with the adaptation device or removed and worn as the earbud would typically be worn without the adaptation device.

21. The method as in claim 16 further comprising the step of removing the earbud from the headphone adaptation device.

22. The method as in claim 16 wherein the step of attaching the earbud to the holding means comprises attaching the earbud to the holding means such that the earbud is substantially upside-down relative to the wearer's ear.

* * * * *